United States Patent [19]

Diaddario, Jr. et al.

[11] Patent Number: 4,976,835

[45] Date of Patent: Dec. 11, 1990

[54] ELECTROSYNTHESIS OF SODIUM DITHIONITE

[75] Inventors: Leonard L. Diaddario, Jr., Portsmouth; Mark A. Schroeder, Norfolk, both of Va.

[73] Assignee: Hoechst Celanese Corporation, Somerville, N.J.

[21] Appl. No.: 406,178

[22] Filed: Sep. 12, 1989

Related U.S. Application Data

[63] Continuation of Ser. No. 164,874, Mar. 8, 1988.

[51] Int. Cl.[5] ..... C25B 1/02; C25B 1/14

[52] U.S. Cl. ..... 204/92; 204/129

[58] Field of Search ..... 204/92, 129, 263

[56] References Cited

U.S. PATENT DOCUMENTS 3,748,238 7/1973 Heit et al. ..... 204/92

3,905,879 9/1975 Eng et al. ..... 204/92

3,920,551 11/1975 Cook et al. ..... 204/92

4,144,146 3/1979 Leutner et al. ..... 204/92

4,743,350 5/1988 Cawlfield et al. ..... 204/255

*Primary Examiner*—T. Tung

*Assistant Examiner*—David G. Ryser

*Attorney, Agent, or Firm*—Depaoli & O'Brien

[57] ABSTRACT

An aqueous sulfuric acid anolyte solution is circulated through the anode compartment of an electrolytic cell, and an aqueous $NaHSO_3$ catholyte solution is circulated through its cathode compartment, while maintaining an anolyte and catholyte temperature range of 20°-25° C., a catholyte pH range of 4.6 to 5.8, and a reduction potential of −1.25 to −1.50 V versus Ag°/AgCl, to produce an aqueous solution of $Na_2S_2O_4$. Optimum pH is maintained by small additions of an alkali to the catholyte solution for electrolysis and solution stability.

8 Claims, 2 Drawing Sheets

ELECTROSYNTHESIS OF SODIUM DITHIONITE

This application continuation of application Ser. No. 164,874, filed Mar. 8, 1988.

BACKGROUND OF THE INVENTION

1. Field of the Invention

This invention relates to dithionites and more particularly relates to electrochemical preparation of dithionites from bisulfites.

2. Review of the Prior Art

Dithionites, commonly termed hydrosulfites, have been used for years to bleach a wide variety of materials including straw, feathers, glue, textiles, and wood pulps. For many such commercial uses in the past, zinc dithionite has been preferred because of its stability in aqueous solution, but ecological considerations in recent years have caused sodium dithionite to be used almost exclusively.

Chemical methods of manufacturing sodium dithionite are generally batchwise and require very careful supervision. An electrochemical process potentially offers many advantages. Particularly enticing are processes for the production of sodium dithionite solutions by cathodic reduction of sulfur dioxide. Reported anode and cathode redox reactions involve the reduction of aqueous sulfur dioxide solutions or sodium bisulfite solutions coupled with the oxidation of sodium chloride or sodium hydroxide solutions. However, the anode and cathode reaction systems therefor have limitations which cause poor conversion to product or product decomposition.

Typically, two-compartment cells are used for the electrolysis in which anode and cathode compartments are separated by a diaphragm or an ion-exchange membrane. In the cathode compartment of the electrolysis cell, aqueous sulfur dioxide is reduced to dithionite by the following half reaction:

$$2SO_2+2e^-\rightarrow S_2O_4^{2-} \quad (1)$$

In the anode compartment of the electrolysis cell, the electrolyte serves two functions. It is the source of sodium ions which are transported through a cation-exchange membrane to the cathode compartment, and it provides a source of easily oxidizable anions. Either a sodium chloride or a sodium hydroxide solution has been used to produce chlorine or oxygen, respectively, by one of the following half reactions:

$$2NaCl\rightarrow Cl_2+2Na^++2e^- \quad (2)$$

$$4NaOH\rightarrow O_2+4Na^++2H_2O+4e^- \quad (3)$$

Therefore, combining half-reaction 1 with either half-reaction 2 or 3 yields a sodium dithionite solution by either of the following overall reactions:

$$2SO_2+2NaCl\rightarrow Na_2S_2O_4+Cl_2 \quad (4)$$

$$4SO_2+4NaOH\rightarrow 2Na_2S_2O_4+O_2+2H_2O \quad (5)$$

When dithionite is produced according to reactions 4 or 5, the acidic catholyte environment of aqueous sulfur dioxide causes difficulties because the acid-catalyzed decomposition rate constant for the dithionite ion is large in the acidic conditions of the aqueous sulfur dioxide. This difficulty limits both product yield and current efficiency.

Alternatively, aqueous sodium bisulfite solutions can be used as the source of sulfur(IV). Bisulfite is reduced to dithionite at the cathode by the following half-reaction:

$$2NaHSO_3+2e-\rightarrow Na_2S_2O_4+2OH- \quad (6)$$

By combining half-reaction 6 with either half-reaction 2 or 3, the following overall reactions result:

$$2NaHSO_3+2NaCl\rightarrow Na_2S_2O_4+2NaOH+Cl_2 \quad (7)$$

$$4NaHSO_3+4NaOH\rightarrow Na_2S_2O_4+4NaOH+2H_2O+O_2 \quad (8)$$

or $$4NaHSO_3\rightarrow 2Na_2S_2O_4+2H_2O+O_2 \quad (9)$$

Reaction 7 produces sodium dithionite and hydroxide at the cathode, while sodium chloride is consumed and chlorine gas is produced at the anode. Reaction 8 produces sodium dithionite and sodium hydroxide at the cathode, while sodium hydroxide is consumed and oxygen gas is produced at the anode.

Although both reactions 7 and 8 produce dithionite under pH conditions where dithionite is stable, the pH of the catholyte increases as the electrolysis proceeds. The pH of the catholyte will increase to the point where reduction becomes unfavorable, thereby limiting the bisulfite-to-dithionite conversion.

In practice, the addition of acid to the catholyte to neutralize the hydroxide produced at the cathode has not been found to be an acceptable solution to the problem. Injection of small volumes of dilute acid into the catholyte produced localized regions of low pH before mixing could produce a homogeneous solution. This condition resulted in significant losses of product due to acid-catalyzed decomposition.

In general, therefore, the traditional half-reaction combinations were found to limit the sulfur(IV) to dithionite conversion either due to dithionite decomposition from highly acidic electrolysis conditions or due to unfavorable thermodynamics as the catholyte pH increases.

U.S. Pat. No. 2,273,799 describes a process for producing sodium hydrosulfite from sodium bisulfite at a porous carbon cathode formed from comminuted solid carbonaceous material and a porous carbonaceous binder.

Two-chambered electrochemical cells, having cation permselective membranes which divide the cell into an anode compartment and a cathode compartment, have been described in U.S. Pat. No. 2,731,408 and may contain graphite and/or steel electrodes, as taught in U.S. Pat. No. 2,978,402.

Mechanical removal of the diffusion layer and electrolytic reduction of sodium dithionite, by use of the wiped-electrode technique with two-compartment cells, produced high yields of sodium dithionite, as reported in *Chemical Communications,* 1968, No. 7, pages 361–362. The anode compartment contained a graphite anode and saturated brine electrolyte. The cathode compartment contained a catholyte of $NaHSO_3$, $Na_2SO_3$, and NaCl and, selectively, a graphite cathode.

A process for making dithionites by electrolysis of an acidic solution of sulfur dioxide, utilizing permselective membranes separating anode and cathode compartments, has been described in *Pulp and Paper Magazine of Canada* in the issue of Dec. 19, 1969, at pages 73–78.

Experimental studies on the cathodic reduction of $SO_2$ in aqueous solution are discussed in terms of the chemical and electrochemical reactions which accompany the flow of current in *Journal of the Electrochemical Society,* 1970, 117 (12), 1604–9.

U.S. Pat. No. 3,523,069 describes an electrolytic process for converting a solution of $SO_2$ in water to an acidic solution of $Na_2S_2O_4$ in the cathode compartment, the anode compartment containing an NaOH solution as anolyte and the cathode and anode compartments being separated by a cation-permeable membrane. Careful control of catholyte temperature at 0°–40° C., catholyte $SO_2$ concentration at 2–25 wt. %, pH at 0.5–3.0, catholyte velocity at 1–40 meters/minute and other variables is required.

U.S. Pat. No. 3,748,238 describes a process for preparing sodium dithionite from sodium bisulfite or sodium metabisulfite in an electrolysis apparatus provided with a special spongy, porous lead electrode used therein as a cathode and substantially filling the catholyte compartment of the apparatus. The porous lead electrode is produced from alkali metal plumbites in the same electrolysis apparatus and remains in place for electrochemical preparation of sodium dithionite.

A process is described in U.S. Pat. No. 3,905,879 for making dithionites which begins with the production of high concentration, chloride-free sodium hydroxide solution and chlorine at a high current efficiency from a three-compartment electrolytic cell having cation-active permselective membranes separating anode and cathode compartments from a buffer compartment so that hydroxide ions migrate into the buffer compartment from a cathode compartment and are therein converted to sulfite by reaction with sulfur dioxide. The sulfite is removed and is subsequently added with additional sulfur dioxide to the cathode compartment of a two-compartment electrolytic cell wherein the cation-active permselective membrane separates the anode and cathode compartments. Chloride solution is electrolyzed to chlorine at the anode, and sulfite solution is electrolyzed to dithionite at the cathode.

U.S. Pat. No. 3,920,551 describes a process for making dithionites electrolytically by adding gaseous $SO_2$ to the cathode compartment of an electrolytic cell in which the anode and cathode compartments are separated by a cation permselective membrane. The anode compartment contains an alkali metal chloride anolyte solution. In the cathode compartment, hydroxyl ions are reacted with $SO_4$ to produce sulfite. The sulfite ions are then reduced to $S_2O_4^{32}$ at 3 to 5 volts, 0.1 to 2 A/in$^2$, a catholyte pH of 6 to 8, an anolyte pH of 2–4, and a temperature of 5°–20° C.

A process for continuous manufacture of concentrated sodium dithionite solutions by cathodic direct reduction of solutions containing sulfite/bisulfite is also described in U.S. Pat. No. 4,144,146, within two-compartment cells divided by a chlorine-resistant cation exchanger membrane consisting of a copolymer of tetrafluoroethylene and a perfluorovinylsulfonic acid containing ether groups.

As can be seen from the preceding review, reported anode and cathode redox reaction systems have limitations which cause poor conversion to product or which cause product decomposition. These redox reaction systems for the electrolytic production of sodium dithionite solutions involve the reduction of aqueous sulfur dioxide solutions or sodium bisulfite solutions coupled with the oxidation of sodium chloride or sodium hydroxide solutions. There is clearly a need for a pH-stable electrochemical process.

SUMMARY OF THE INVENTION

It is accordingly an object of this invention to overcome these problems with the electrolytic production of sodium dithionite by providing a redox reaction system wherein there is no net production or consumption of either protons or hydroxide ions in the overall reaction.

It is further an object to maintain charge balance in the production of sodium dithionite by enabling the protons to migrate through the cation-exchange membrane separating the anode and cathode compartments, whereby the catholyte pH remains constant at the optimum pH for electrolysis and solution stability.

It is additionally an object to provide a unique half-reaction system which maintains the catholyte at a substantially constant pH which can be adjusted to control the solution decomposition of sodium dithionite and to control electrolysis rate.

It is another object to optimize the electrolysis conditions as to reduction potential, catholyte pH, and electrolysis temperature.

It is still further an object to maximize the bisulfite-to-dithionite conversion and to minimize the bisulfite-to-thiosulfate conversion of both electrochemical and solution decomposition pathways.

It is finally an object to maximize the current efficiency of this half-reaction system.

In accordance with these objectives and the spirit of this invention, an anode/cathode redox reaction system is provided in which sodium bisulfite is reduced to sodium dithionite at the cathode according to reaction 6 while water is oxidized to oxygen under acidic conditions at the anode according to the following half reaction:

$$2H_2O \rightarrow O_2 + 4H^+ + 4e^- \quad (10)$$

The advantage of using respective anode and cathode reactions 10 and 6 is that there is no net production or consumption of either protons or hydroxide ions in the following overall reaction:

$$4NaHSO_3 + 2H_2O \rightarrow 2Na_2S_2O_4 + O_2 + 4H_2O \quad (11)$$

or $$4NaHSO_3 \rightarrow 2Na_2S_2O_4 + O_2 + 2H_2O \quad (12)$$

Reaction 11 produces dithionite at the cathode and oxygen gas at the anode. There is no net production or consumption of protons or hydroxide ions. The number of moles of protons produced at the anode are equal to the number of moles of hydroxide ions produced at the cathode. To maintain charge balance, the protons produced at the anode migrate through the cation-exchange membrane which separates the anode compartment from the cathode compartment. Thus, the catholyte pH should remain constant throughout the electrolysis. By using reaction 11, the catholyte pH should remain in the range for optimum electrolysis, and dithionite decomposition is controlled because the catholyte pH is not highly acidic.

The membrane which is to separate the anode compartment from the cathode compartment is a Nafion ® membrane which is a permselective membrane of sulfonated fluorocarbon polymer, designed to permit selective passage of cations. In practice, the Nafion cation-exchange membrane used is not 100% efficient. Some proton-for-sodium ion exchange takes place across the membrane even when no potential is applied to the electrodes. This dialysis causes the catholyte pH to become more acidic, but it has been discovered that the catholyte can be maintained at a constant pH by small additions of a base, such as sodium hydroxide.

This process for the electrolytic formation of a dithionite salt comprises the following steps:

A. providing an electrolytic cell having an anode compartment containing an anode, a cathode compartment adjacent the anode compartment and containing a cathode, a cation permselective membrane between the compartments, inlet and outlet means for each compartment, means for maintaining a selected electrolysis temperature, and means for imposing electrical current across the cathode and anode;

B. circulating an aqueous bisulfite salt-containing catholyte solution through the cathode compartment;

C. circulating an aqueous acid anolyte solution through the anode compartment;

D. imposing an electrical current across the anode and cathode, whereby a dithionite salt is produced from the bisulfite salt in the cathode compartment;

E. maintaining a selected electrolysis temperature; and

F. maintaining a selected pH in the cathode compartment by addition thereto of a dilute alkaline solution.

It is highly preferred that these steps be preceeded by the step of admixing gaseous $SO_2$ with dilute sodium hydroxide solution to form the catholyte solution and by the step of admixing gaseous $SO_2$ with water to form a solution of sulfurous acid which is oxidized in the anode compartment to sulfuric acid at a concentration of approximately 1 molar. In the actual examples which follow, admixing $SO_2$ with NaOH formed a catholyte solution of 0.50M $NaHSO_3$. Quite obviously, different designs can change the concentration of $NAHSO_3$.

The preferred anode for this electrolysis has a low overpotential for oxygen evolution under acidic conditions. However, other electrode materials, such as noble metals like platinum, for example, can be used at the expense of increased oxygen evolution overpotential. Materials of this type are known [See German Offen. No. 2,331,959 (C.A. Vol 80, 1974, p. 522) and German Offen. No. 2,331,949 (C.A. Vol. 82, 1975, p. 486)]. The preferred anode is the DSA-$O_2$ ® (pH below 2) of the Electrosynthesis Company, Inc., P.O. Box 16, E. Amherst, N.Y. 14051, which is made of ruthenium oxide on titanium.

The cathode which is preferably utilized is conventional and can be at least one noble metal such as gold, silver, platinum, palladium, or rhodium or a non-noble metal such as copper and nickel, or carbon, such as graphite and reticulated vitreous carbon (RVC). The preferred cathode is graphite.

The dimensionally stable and cation-permselective membrane used in the cell includes fluorinated polymers. These and other materials are disclosed in U.S. Pat. Nos. 3,920,551 and 3,905,879 which are hereby incorporated by reference.

Perfluorosulfonic acid products, sold by the Du Pont Plastic Products and Resins Department under the trademark Nafion, are the preferred membrane material. The membranes are available with reinforcement of fabric of Teflon ® TFE fluorocarbon resin which provides a mechanically durable, all-fluorocarbon product with outstanding chemical and temperature resistance. These Nafion ® products are copolymers of tetrafluoroethylene and monomers such as perfluoro-3, 6-dioxa-4-methyl-7-octensulfonic acid.

Background information on the manufacture and use of Nafion ® perfluorosulfonic acid products is available in Du Pont's *Innovation Magazine,* Volume 4, Number 3, Spring, 1973, "NAFION, an Electrochemical Traffic Controller".

The redox reaction process of this invention offers several surprising advantages over the conventional reduction of aqueous sulfur dioxide and oxidation of sodium hydroxide. These advantages include (1) no net gain or loss of protons and, ideally, constant pH, and (2) feeding sodium bisulfite solutions, instead of strongly acidic aqueous sulfur dioxide solutions, to the cathode compartment, thereby helping the pH of the catholyte recycle to be maintained at a relatively constant value of slightly acidic to neutral pH throughout the electrolysis.

Suitable process conditions were found to be: an optimum catholyte temperature range of 20°-25° C., an optimum catholyte pH range of 4.6–5.8, a preferred pH value of 5.16, and an optimum range for reduction potential of −1.25 V to 1.50 V versus Ag°/AgCl, the preferred reduction potential being −1.37V.

DESCRIPTION OF THE PREFERRED EMBODIMENT

The anode/cathode redox reaction system of this invention is operationally most practicable on a large scale when using gaseous $SO_2$ for reacting with a dilute NaOH solution to provide an $NaHSO_3$ catholyte solution and for dissolving in water to provide a dilute acid anolyte solution. However, for laboratory experimentation, $Na_2S_2O_5$ was a more convenient source of $NaHSO_3$ solution, and $H_2SO_4$ was a more convenient source of acid anolyte solution.

Figure 1:
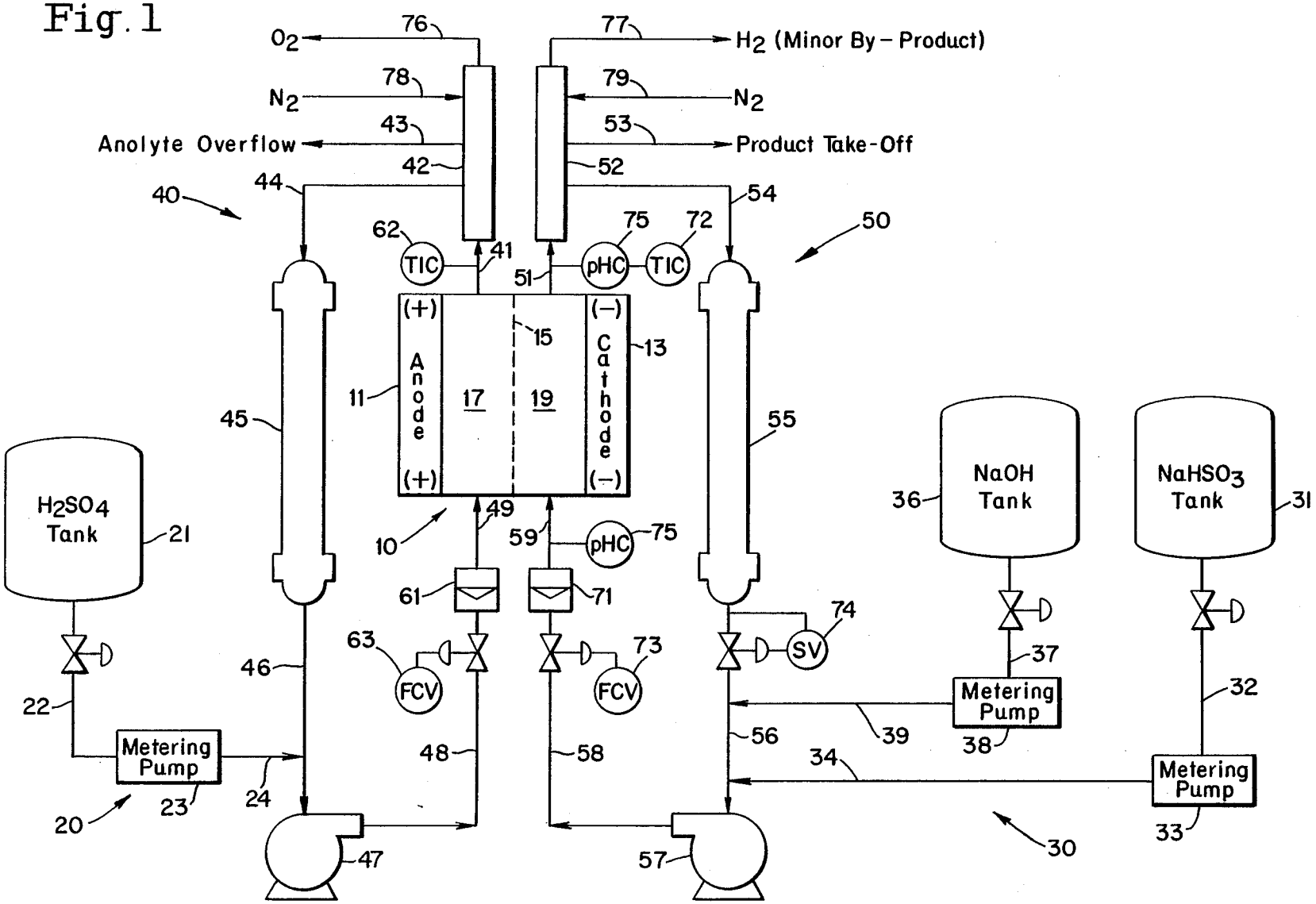
FIG. 1 is a process flow diagram and a plan view of a laboratory-scale pilot electrolysis unit.

An electrolysis unit is shown in FIG. 1 which also includes a process flow diagram. The unit comprised a two-compartment electrolysis cell 10, anolyte supply system 20, catholyte supply system 30, anolyte product take-off and recirculation system 40, catholyte take-off and recirculation system 50, and instrumentation 61–79.

Cell Design

Electrolysis cell 10 was a monopolar, plate-and-frame type ElectroCell MP-Cell from ElectroCell AB (Akersberga, Sweden). Cell 10 was equipped with a 0.02 $m^2$ graphite cathode 13, a 0.01 $m^2$ DSA-$O_2$ ® (pH below 2) anode 11, and a Nafion 324 cation-exchange membrane 15 to form an anolyte half cell 17 and a catholyte half cell 19. Electrolysis cell 10 was powered from a Sorensen Nobatron DC power supply, Model DCR20-125.

The entire electrolysis unit was constructed from non-metallic components. All plumbing was constructed from PVC pipe, connectors, and valves. The anolyte and catholyte were respectively fed from tanks 21, 31 through lines 22, 24 and 32, 34 with electronic metering pumps 23, 33, made by Liquid Metronics, Inc., Model A121-95T. Concentrated sodium hydroxide was fed from tank 36 through lines 37, 39 into the catholyte recycle with an electronic metering pump 38, made by Liquid Metronics, Inc. Model A751-95T. The anolyte and catholyte were respectively recycled through lines 41, 44, 46, 48, 49 and 51, 54, 56, 58, 59 with seal-less, magnetic drive, centrifugal, chemical pumps 47, 57, having polypropylene bodies and impellers and with polypropylene encased magnets from March Manufacturing, Inc., Model TE-5.5C-MD. Recycle flow rates were monitored with non-metallic rotameters 61, 71, having polysufone bodies, CPVC end connections, and PVC internals from Electrosynthesis Co., Inc., Model M200-C-2-HT-V. Recycle flow rates were controlled by flow control valves 63, 73. The anolyte and catholyte recycles were cooled through all-glass heat exchangers 45, 55 from Corning Process Systems, Model HE 1.5. The anolyte and catholyte recycle temperatures was monitored with FEP coated, type J thermocouples 62, 72 from Omega Engineering, Inc., part number ICSS-18G-12-FEP. Catholyte pH was monitored with a double-junction, combination electrode 75 for high sodium ion solutions from Cole-Parmer Instrument Co., part number J-5994-23, connected to an Orion Model 211 digital pH meter.

A sodium dithionite solution, as catholyte product, was removed through line 53. Oxygen was removed from the anolyte through line 76, and hydrogen was removed from the catholyte, as a minor byproduct, through line 77. Nitrogen was selectively fed to the respective half cells through lines 78, 79. Catholyte samples were selectively removed through sample valve 74.

The laboratory-scale pilot electrolysis unit was monitored and controlled by an Apple IIe computer system with an ISAAC Model 91A data acquisition and control system. Control electronics were designed and constructed, and a computer program was developed to allow unattended, independent control of the anolyte recycle temperature, the catholyte recycle temperature, and the catholyte pH. The control program also included data logging features which would record the following operating parameters: cell potential; current; catholyte pH; catholyte temperature; and anolyte temperature.

The progress of the electrolysis reaction was monitored at periodic time intervals by determining the molar concentration of dithionite, bisulfite, and thiosulfate in the catholyte recycle. Standard iodimetric titrations were adapted to perform these analyses.

Process Optimization

The following experimental parameters were investigated: reduction potential; catholyte pH; reduction temperature; catholyte recycle volume; and catholyte and anolyte recycle rate. It was found that recycle rate did not significantly effect the bisulfite-to-dithionite conversion. However, the recycle rate was adjusted at the beginning of each run to give the maximum current passage. The best results were obtained when the volume of the plumbing of the pilot electrolysis unit was minimized to give the maximum number of passes through the electrolysis cell per a given unit of time.

The reduction potential and catholyte pH were found to have the greatest effect on the bisulfite-to-dithionite conversion. Catholyte recycle temperature was found to have a moderate effect on the conversion. Batch electrolyses were run to optimize these three operating parameters. The batch electrolyses were performed under the following conditions: the initial concentration of the catholyte solution was 0.50M $NaHSO_3$; the anolyte solution was 1M $H_2SO_4$; the catholyte recycle volume was 2.7–4.3 liters; the anolyte recycle volume was 5.0–10.4 liters; and the anolyte and catholyte recycle rates were 3.8–41. gal/min.

The reduction potential was varied over a potential range of −1.25 to −1.75 V versus Ag°/AgCl. The catholyte pH was varied from 4.25 to 5.25. The electrolyses were run for five hours at the following temperature ranges: 11°–13° C., 24°–28° C.; and 41°–46° C. The bisulfite-to-dithionite conversion, the bisulfite-to-thiosulfate conversion, bisulfite reacted, and the current efficiency were calculated by the following equations:

$$\% \ Na_2S_2O_4 \text{ Conversion} = \frac{[Na_2S_2O_4]_{5\ hr}}{2[NaHSO_3]_{in}} \times 100 \quad (13)$$

$$\% \ Na_2S_2O_3 \text{ Conversion} = \frac{[Na_2S_2O_3]_{5\ hr}}{2[NaHSO_3]_{in}} \times 100 \quad (14)$$

$$\% \ NaHSO_3 \text{ Reacted} = \frac{[NaHSO_3]_{in} - [NaHSO_3]_{5\ hr}}{[NaHSO_3]_{in}} \times 100 \quad (15)$$

$$\% \text{ Current Efficiency} = \frac{2(\text{Recycle Vol})\ [Na_2S_2O_4]}{\text{Equiv } e^-} \times 100 \quad (16)$$

The results of these electrolyses are presented in Table 1. It was found that increasing temperature drives the reduction reaction, as can be seen by the increased percent of bisulfite reacted. However, the rate of the dithionite solution decomposition reaction increased more rapidly than the reduction reaction. Thus, approximately 20° C. to 25° C. was found to be the optimum electrolysis temperature where a good bisulfite-to-dithionite conversion rate could be obtained without significant decomposition to thiosulfate.

TABLE 1

Conversion and current efficiency data from five-hour batch electrolyses for the optimization of electrolysis temperature, catholyte pH, and reduction potential.

| Temperature °C. | Catholyte pH | Cell Potential (V vs Ag°/AgCl) | $NaHSO_3$ Reacted (mol %) | $Na_2S_2O_3$ Formed (mol %) | $Na_2S_2O_4$ Formed (mol %) | Current Efficiency (%) |
|---|---|---|---|---|---|---|
| 12 | 4.25 | −1.25 | 26.1 | 0.1 | 31.6 | 87.6 |
| 13 | 4.25 | −1.25 | 27.9 | 0.2 | 32.6 | 91.5 |
| 12 | 4.25 | −1.75 | 43.3 | 6.7 | 42.0 | 72.0 |
| 12 | 4.75 | −1.50 | 34.3 | 1.3 | 38.3 | 85.1 |
| 12 | 5.25 | −1.25 | 19.9 | N.D. | 25.7 | 81.3 |
| 11 | 5.25 | −1.75 | 35.2 | 8.5 | 31.1 | 53.4 |
| 13 | 5.75 | −1.50 | 27.2 | 3.8 | 28.5 | 62.5 |
| 11 | 6.50 | −1.75 | 5.7 | 4.1 | 4.3 | 7.3 |
| 26 | 4.25 | −1.25 | 42.0 | 1.7 | 45.4 | 90.9 |
| 26 | 4.25 | −1.25 | 44.1 | 2.6 | 44.6 | 89.7 |

TABLE 1-continued

Conversion and current efficiency data from five-hour batch electrolyses for the optimization of electrolysis temperature, catholyte pH, and reduction potential.

| Temperature °C. | Catholyte pH | Cell Potential (V vs Ag°/AgCl) | $NaHSO_3$ Reacted (mol %) | $Na_2S_2O_3$ Formed (mol %) | $Na_2S_2O_4$ Formed (mol %) | Current Efficiency (%) |
|---|---|---|---|---|---|---|
| 27 | 4.25 | −1.50 | 53.5 | 7.1 | 49.4 | 75.7 |
| 28 | 4.25 | −1.75 | 55.0 | 14.8 | 47.8 | 59.8 |
| 26 | 4.50 | −1.37 | 59.4 | 3.0 | 55.9 | 86.7 |
| 25 | 4.75 | −1.25 | 47.8 | 1.7 | 48.9 | 82.5 |
| 26 | 4.75 | −1.50 | 50.9 | 3.6 | 52.3 | 83.2 |
| 24 | 5.00 | −1.37 | 55.3 | 1.7 | 59.6 | 86.8 |
| 27 | 5.25 | −1.25 | 37.3 | 0.5 | 43.1 | 92.7 |
| 25 | 5.25 | −1.50 | 61.6 | 3.1 | 55.4 | 39.7 |
| 27 | 5.25 | −1.75 | 61.4 | 10.9 | 51.3 | 62.0 |
| 44 | 4.25 | −1.25 | 44.5 | 21.8 | 25.8 | 37.3 |
| 46 | 4.25 | −1.75 | 67.3 | 50.2 | 10.9 | 9.6 |
| 41 | 4.75 | −1.50 | 65.3 | 13.7 | 50.8 | 62.1 |
| 42 | 5.25 | −1.25 | 51.1 | 4.1 | 47.6 | 77.2 |
| 42 | 5.25 | −1.25 | 44.9 | 3.6 | 34.2 | 45.8 |
| 45 | 5.25 | −1.75 | 76.0 | 31.9 | 47.9 | 44.6 |

At 25° C., a modified fractional factorial experimental design was used to optimize the catholyte pH and the reduction potential with respect to bisulfite-to-dithionite conversion, bisulfite-to-thiosulfate conversion, and current efficiency. The bisulfite-to-dithionite conversion data were represented by the following best fit equation:

$$\%Na_2S_2O_4 = -515.9 + 161.6(pH) - 235.5(V) - 18.2(pH)^2 - 91.2(V)^2 - 9.6(pH)(V) \quad (17)$$

Equation 17 has a correlation coefficient of 0.997. The bisulfite-to-dithionite conversion reached a maximum at −-1.37 to −1.50 V versus Ag°/AgCl and pH 5.00–5.25.

The bisulfite-to-thiosulfate conversion data were represented by the following best fit equation:

$$\%Na_2S_2O_3 = 73.7 - 11.8(pH) - 67.8(V) + 1.7(pH)^2 + 38.1(V)^2 + 5.1(pH)(V) \quad (18)$$

Equation 18 has a correlation coefficient of 0.995 and shows, when plotted as a calculated three-dimensional response surface, that more thiosulfate is formed as the catholyte pH decreases and as the reduction potential becomes more cathodic. This result indicates that thiosulfate is formed by an electrolytic pathway in addition to the dithionite solution decomposition pathway.

The best fit equation for the current efficiency data is the following saddle function:

$$\%\ \text{Current Eff.} = 179.4 - 107.4(pH) - 254.2(V) + 11.1(pH)^2 - 109.8(V)^2 - 3.5(pH)(V) \quad (19)$$

Equation 19 has a correlation coefficient of 0.999. However, there was insufficient data to determine if the saddle effect was real. Catholyte pH did not appear to have a large effect on the current efficiency. The current efficiency did decrease rather quickly, however, as the reduction potential became more cathodic. This phenomenon can be attributed to over-reduction of $Na_2S_2O_4$ and reduction of water. The optimum reduction potential for current efficiency was found to be −1.25 to −1.37 V versus Ag°/AgCl.

The overall equation, which describes the net effect of maximizing the bisulfite-to-dithionite conversion, minimizing the bisulfite-to-thiosulfate conversion, and maximizing the current efficiency, can be calculated by summing equation 17, equation 19, and the negative of equation 18. The resulting equation, which describes the net effect, is:

$$Z = -410.1 + 66.0(pH) - 557.5(V) - 8.8(pH)^2 - 239.0(V)^2 - 18.1(pH)(V) \quad (20)$$

The calculated net effect can be plotted on the Z axis of a three-dimensional response surface where the X axis is the catholyte pH from 4.0 to 5.5 and the Y axis is the reduction potential from −2.0 V to −1.0 V versus Ag°/AgCl. To determine the response surface maximum, equation 20 was differentiated with respect to catholyte pH and to reduction potential.

$$\frac{dz}{dpH} = 0 = 66.0 - 17.6(pH) - 18.1(V) \quad (21)$$

$$\frac{dz}{dV} = 0 = -557.5 - 18.1(pH) - 478.1(V) \quad (22)$$

Figure 2:
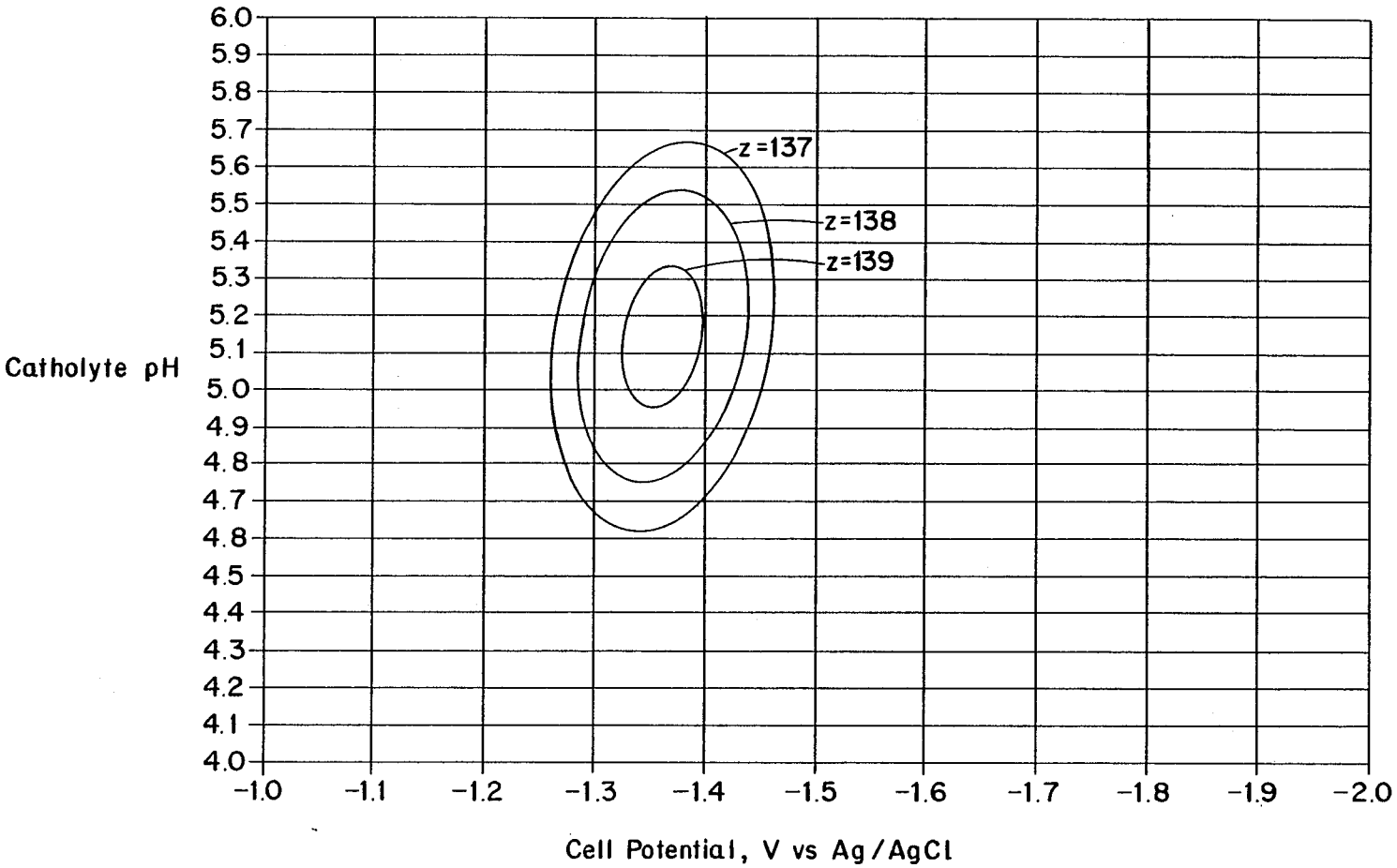
FIG. 2 is a contour map showing the catholyte pH range and reduction potential range which are optimum, the preferred values being at the center.

Solving the two simultaneous equations for the catholyte pH and the reduction potential yielded the preferred operating conditions of −1.37 V versus Ag°/AgCl and pH 5.16, as the apex of the contour map shown in FIG. 2.

Because it will be readily apparent to those skilled in the art of electrolytic production of aqueous dithionite salt solutions that innumerable variations, modifications, amplifications, and extensions of the examples and principles hereinbefore set forth can be made without departing from the spirit and the scope of the invention, what is hereby defined as such scope and is desired to be protected should be measured, and the invention should be limited, only by the following claims.

What is claimed is:

1. In the electrolytic production of an aqueous dithionite salt solution, the improvement that comprises:

A. conducting the electrolysis in a two-compartment cell comprising: (1) an anode compartment containing an anode through which a sulfuric acid anolyte solution is circulated and (2) a cathode compartment containing a cathode and through which an aqueous sodium bisulfite salt solution is circulated as a catholyte therein and a cation permaselective membrane which is sealably disposed between said anode and cathode compartments; and B. maintaining the following circulating conditions:

(1) an anolyte and catholyte temperature range of 20°-25° C., (2) a catholyte pH range of 4.8-5.2, (3) a reduction potential of −1.25 to −1.50 V versus Ag°/AgCl, and (4) reducing said bisulfite solution to sodium dithionite at the cathode according to the reaction:

$$2NaHSO_3+2e\rightarrow NaS_2O_4+2OH-$$

while oxidizing water under acidic conditions at the anode according to the reaction:

$$2H_2O\rightarrow O_2+4H^++4e^-,$$

and thereby providing substantially no net consumption of protons or hydroxide ions in the overall reactions:

$$4NaHSO_3+2H_2O\rightarrow 2Na_2S_2O_4+O_2+4H_2O \text{ or } 4NaHSO_3\rightarrow 2Na_2S_2O_4+O_2+2H_2O;$$

whereby the catholyte pH remains substantially constant over a pH range of 4.8 to 5.2.

2. The improved process of claim 1, wherein said catholyte pH is maintained by selective addition of small quantities of an alkali.

3. The improved process of claim 2, wherein said aqueous bisulfite salt solution is obtained as sodium bisulfite by premixing water and sodium metabisulfite.

4. The improved process of claim 2, wherein said cathode is a graphite cathode.

5. The improved process of claim 2, wherein said sulfuric acid anolyte solution is formed by dissolving sulfur dioxide in water.

6. The improved process of claim 5, wherein said sulfuric acid anolyte solution is approximately 1 molar.

7. The improved process of claim 1, wherein said aqueous bisulfite salt solution is formed as sodium bisulfite by dissolving sulfur dioxide in a dilute solution of sodium hydroxide.

8. The improved process of claim 1, wherein said catholyte pH is 5.16 and said reduction potential is −1.37 V versus Ag°/AgCl.

* * * * *